US005423425A

United States Patent [19]

Stompe

[11] Patent Number: 5,423,425

[45] Date of Patent: Jun. 13, 1995

[54] STORE SHELF BROCHURE HOLDER AND BLANK THEREFOR

[76] Inventor: Brian K. Stompe, 110 San Mateo Way, Novato, Calif. 94945

[21] Appl. No.: 123,346

[22] Filed: Sep. 17, 1993

[51] Int. Cl.[6] ..... B65D 85/48; A47H 1/04

[52] U.S. Cl. ..... 206/449; 206/44 B; 211/70.1; 211/90; 211/94

[58] Field of Search ..... 206/449, 494, 425, 44 B; 211/50, 55, 94, 90, 126, 70.1

[56] References Cited

U.S. PATENT DOCUMENTS

| | | | |
|---|---|---|---|
| 1,331,682 | 2/1920 | Smith | 211/55 X |
| 1,459,538 | 6/1923 | Klatt | 211/55 X |
| 2,283,546 | 5/1942 | Fischer | 211/55 X |
| 2,333,717 | 11/1943 | Heed et al. | 211/50 X |
| 3,023,929 | 3/1962 | Stein | 206/494 X |
| 4,215,840 | 8/1980 | Barberl . | |
| 4,301,987 | 11/1981 | Conway . | |
| 4,630,731 | 12/1986 | Albery . | |
| 4,828,121 | 5/1989 | Willcocks, Jr. | 211/94 |

OTHER PUBLICATIONS

Fasteners For Retail, Inc. 1993 Catalog, p. 41.
Fasteners For Retail, Inc. 1993 Catalog, p. 36.
Fasteners For Retail, Inc. copy 1993 Info-Systems TM Brochure.

*Primary Examiner*—Bryon P. Gehman

[57] ABSTRACT

A die cut and scored blank from thin, stiff material such as paper or plastic and a literature holder assembled therefrom. The holder includes two shelf strip panels cut to permit attachment of the holder, without use of additional fixtures, adhesives, or adhesive devices, to the pricing channel, which is the facing on most retail store shelves, so that the weight of the holder's contents are cantilevered against the store shelf for level display at 90 degrees to the store shelf, the optimum angle for viewing by consumers approaching from either direction. Shelf strip panels of the holder adjoin the side panels, which hold the contents upright, providing a printing surface which may be used to call attention to the holder's contents, or if the holder is constructed of clear material, permitting full viewing of the holder's contents. Bottom panels of the holder hinge from the side panels so when bottom panels are overlapped and locked into place, they hold the side panels firmly in place while providing a secure bottom on which the holder's contents rest. The cut of the bottom panels and the common score by which the side panels are joined, permit formation without binding, leaving a smooth narrow profile in front of the shelf for minimum interference with view of, or access to, product on the shelf. Attached to one bottom panel is a tab lock, which engages a slit in the opposite bottom panel, quickly and easily locking the entire holder together for use.

10 Claims, 2 Drawing Sheets

STORE SHELF BROCHURE HOLDER AND BLANK THEREFOR

BACKGROUND OF THE INVENTION & DESCRIPTION OF PRIOR ART

1. Background—Field of Invention

This invention relates to a holder for brochures, coupons, and literature, and the die cut blank therefor, which when assembled, displays these items referred to herein hereafter as literature, from a store shelf "pricing channel", also referred to as a "shelf strip", located on the outside edge of the store shelf facing the aisle, in a way that the literature holder's contents will most easily be seen by consumers approaching from either direction in store aisles.

2. Background—Description of Prior Art

Consumers frequently make buying decisions while walking aisles of retail stores. Calling an approaching consumer's attention to coupons and literature at the store shelf where a product is displayed among similar products, helps locate the product and differentiate it from products around it.

Literature holders currently available are generally made primarily to display from a flat surface, such as counter or table, and to display their contents in one direction, from the front of the holder.

Some literature holders can be used to display from the store's shelf edge pricing channel, by use of a separate fastener which attaches the back of the holder to the pricing channel, so the holder faces outward from the shelf. This positioning holds the contents so they are best seen from in front of the holder.

U.S. Pat. No. 4,630,731, to Albery (1986) is typical. Albery's holder and most other holders designed for display from the front of the holder, can be displayed from the shelf edge pricing channel, if a hole should be die cut in the back panel, through which a fastener may be passed, and which fastener itself attaches to the store shelf pricing channel or to another fastener which is attached to the pricing channel.

This is clearly illustrated by the Spider Clip, U.S. Pat. No. 4,301,987 to Conway, (1981), a plastic device which attaches to the pricing channel, and has molded to it a couple dart clips, which may be broken away and passed through the back panel of a literature holder to fasten it to the Spider Clip which is attached to the shelf pricing channel.

Similarly, the Shelf Extender Clip, U.S. Pat. No. 4,215,840 to Babberl, (1980), fastens to the shelf pricing channel and has on it an adhesive pad to which the back of a literature holder may be pressed for attachment to the shelf edge, presenting the literature holder in the same way the spider clip would hold it, facing outward.

Fasteners For Retail, Inc., of Cleveland, Ohio, is a leading distributor of literature holders and means of fastening them to store shelves. The Shelf Extender Clip, Spider Clip, and a number of typical literature holders, some with patents pending, are pictured with illustrations of how they typically attach literature holders to the store shelf pricing channel, on pages 41 and 36 of the "Fasteners For Retail, Inc." 1993 Catalog. Current state of the art for literature holders die cut with provision for shelf attachment are also shown in Fasteners For Retail, Inc. Literature entitled, "info-systems TM". These references are attached.

In many instances it is preferable to have a literature holder which displays its contents at a 90 degree angle to the shelf, so the contents may be arranged to face consumers advancing from either direction, rather than facing outward from the shelf. Displays which face outward from the shelf display the contents primarily to consumers positioned directly in front.

A literature holder would be more conveniently attached to the shelf pricing channel, if it could be attached without additional fasteners, adhesive pads or tools.

It would be more convenient and economical if it were not necessary to inventory or carry along additional items like fasteners, without which a literature holder cannot be attached to the store shelf pricing channel.

SUMMARY OF THE INVENTION

Accordingly, it is an object of this literature holder, to hold information, including brochures, coupons, literature, etc. relative to a product, so they face at approximately 90 degrees from the store shelf, and the contents may be arranged for optimum viewing by consumers approaching from either direction.

It is an object that the literature holder may be printed, providing signage calling attention to the holder's contents, and the related product on the shelf, or that it may be made of clear material, completely displaying properly arranged contents of brochures, coupons, literature, etc. to consumers approaching from either direction.

It is an object that this literature holder provide its own means of attachment to the store shelf pricing channel, eliminating the need of additional fasteners, adhesive devices, or tools and their expense.

It is an object to provide this literature holder at low cost and for it to be easily produced from Paper, Plastic or similar light weight materials which can be readily die cut, scored, and, optionally printed.

It is an object that it can be shipped flat, taking little space to store and carry, while at the same time, it can be assembled quickly and easily without use of special skills, tools, fasteners, or adhesive device.

Other objectives and advantages of the invention will become apparent upon reading the following detailed description and reference to drawings.

DETAILED DESCRIPTION OF PREFERRED EMBODIMENT

Figure 1:
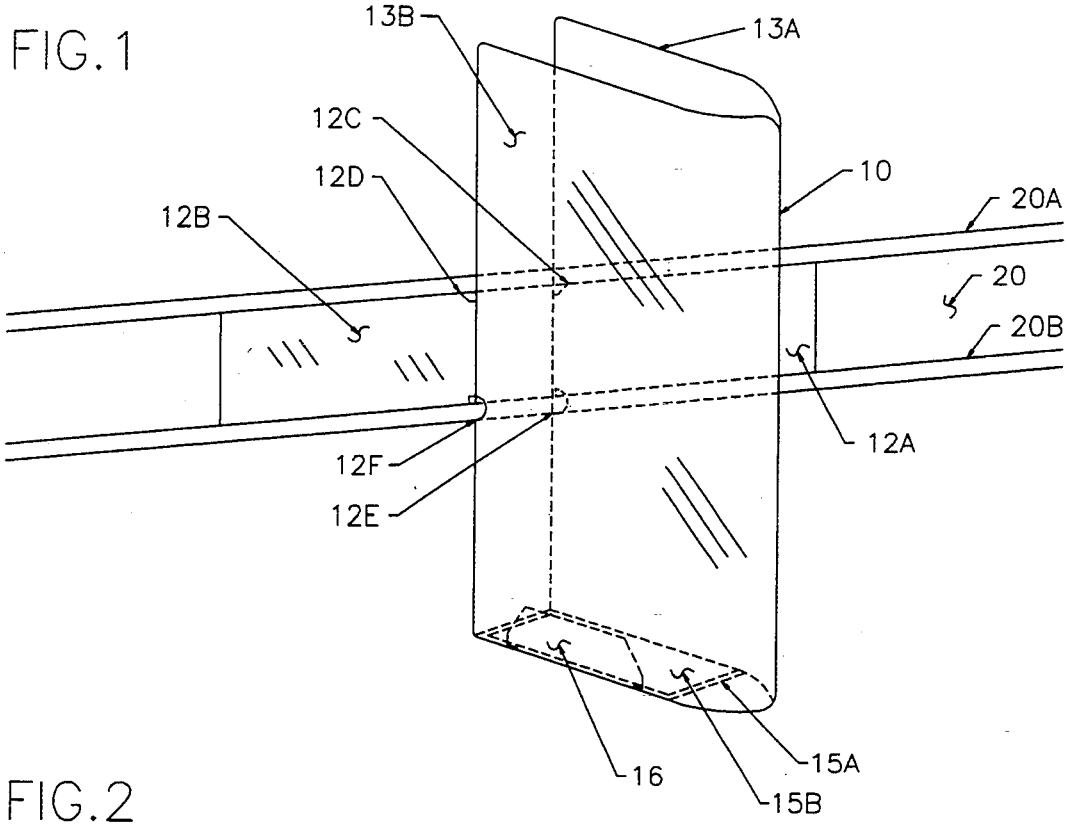
FIG. 1 shows the assembled literature holder attached to the store shelf pricing channel.
Figure 2:
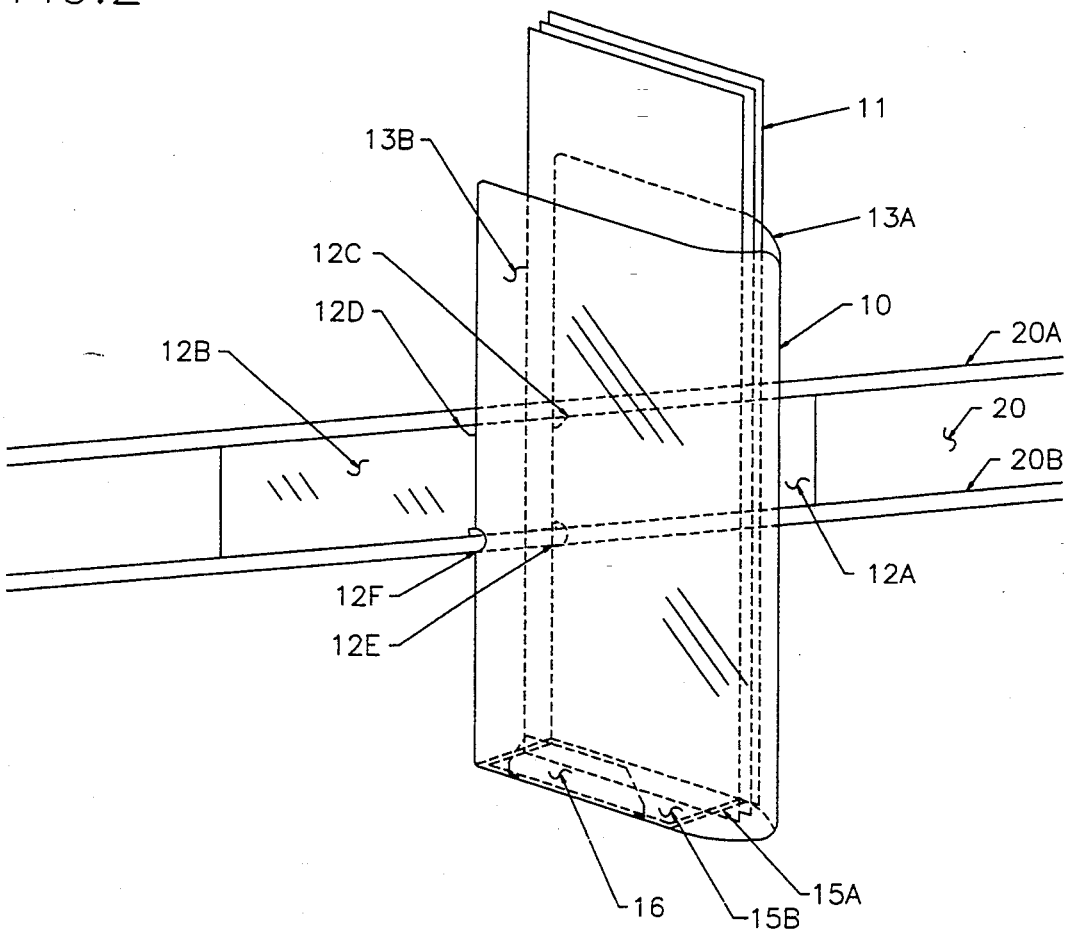
FIG. 2 shows the assembled literature holder displaying literature at approximately 90 degrees to the store shelf

Turning to the figures of the drawing, there is seen in FIG. 1, an empty, assembled holder for literature, and in FIG. 2, an assembled holder with literature in it, both drawings showing the literature holder attached to the store shelf pricing channel, and are indicated generally by 10.

Figure 3:
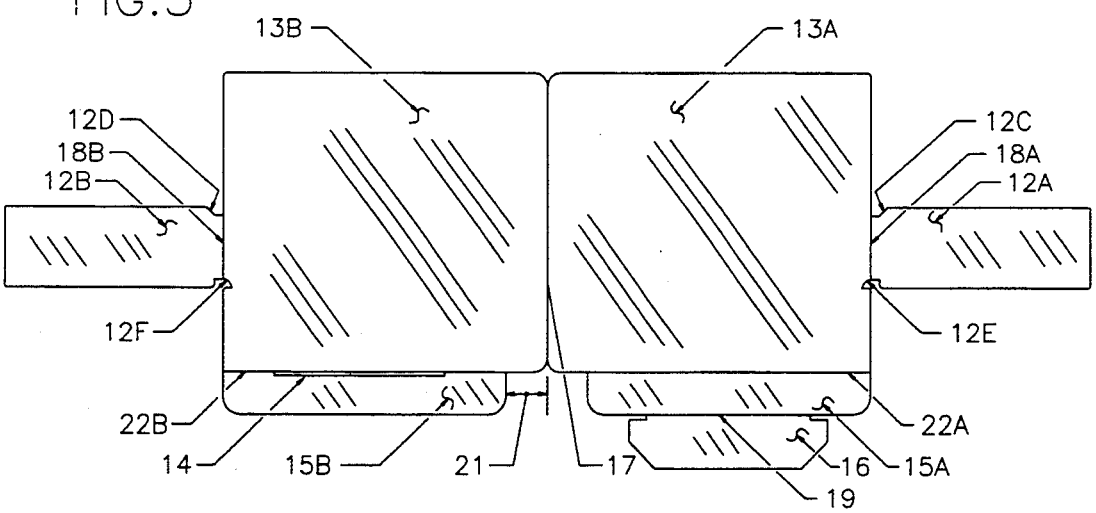
FIG. 3 shows the exterior view of the literature holder in its flat blank form
Figure 4:
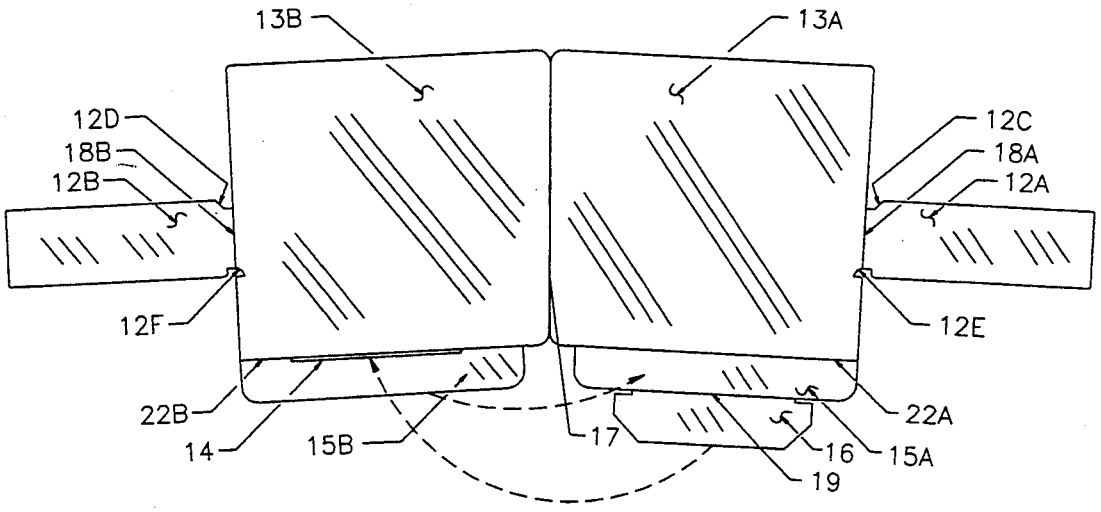
FIG. 4 shows the interior view of the literature holder in its flat blank form as it is flexed for assembly.

The literature holder in FIG. 1 and FIG. 2, is assembled from a die cut and scored blank as illustrated in unassembled blank FIG. 3, exterior view, and FIG. 4, interior view. It is made from paper, plastic or any light weight material which may be die cut and scored and which material has the necessary rigidity to perform the function of "holder" when die cut and formed in the prescribed manner, for attachment to the store's shelf pricing channel. It may be constructed of clear material through which the holder's contents may be seen, or the material may be opaque or may be wholly or partially printed to proclaim the nature of the holder's contents.

A metal attachment to the edge of the store shelf, commonly referred to as a "pricing channel, illustrated at 20 on FIG. 1 and FIG. 2, is constructed with two metal chines, as illustrated at 20A and 20B on FIG. 1 and FIG. 2, one chine at the top and one chine at the bottom, uniform in spacing, so any strip of thin, flexible material having the required rigidity, measuring approx. 1 3/16" in width commonly called a "shelf strip" may be pressed into it, and will lodge there, secured under the chines.

In keeping with one aspect of the literature holder, it incorporates two shelf strip panels, 12A and 12B, each attached to a side panel and each shelf strip panel die cut to secure the literature holder, without an additional fastening device, tools, or adhesive fastener, to the pricing channel and hold it there at an approximately level attitude, for display of contents at 90 degrees to the shelf, despite the fact the pricing channel presents itself to the holder at a backward tilt of approx. 25 degrees, which would otherwise cause the holder to tilt backwards, possibly dropping the contents out the back. The two angled die cuts at 12C and 12D, work in combination with the two cut outs shaped like the shelf channel chine, 12E and 12F, on panels 12A and 12B, to assume an optimum attitude when the holder is attached.

Additionally, it is seen that side panels 13A and 13B, which are attached to panels 12A and 12B, contain the holder's contents in an upright position, while the contents are securely supported from below by two overlapping panels, 15A and 15B, locked in place by tab lock 16.

Also note, panels 15A and 15B are die cut to terminate at a distance equal to approximately the width of the holder, from a projection downward from score 17, as shown at 21. This enables the holder to fold without binding or bunching at the end, while providing a secure bottom, and provides bracing necessary to position panels 13A and 13B, defining the width of the holder.

Referring to the interior view of the blank shown in FIG. 4, to assemble the die cut and scored blank into a brochure holder, initially panels 13A and 13B are folded inward toward each other on score 17, while folding panels 15A and 15B upward 90 degrees, on scores 22A and 22B, so panel 15A overlaps 15B and is secured by folding tab 16 on score 19, and inserting tab 16 into slit 14. When strip 12A is folded at 90 Degrees to side panel 13A, and strip 12B is folded at 90 degrees to side panel 13B, strips 12A and 12B may then be pressed into the store's pricing channel, where upon the edges of strips 12A and 12B snap under the chines of the pricing channel, and are locked there, without use of any additional fastener, tools, or adhesive device, holding the literature holder at approximately 90 degrees to the shelf, the best angle for viewing by approaching consumers.

Thus it can be seen that a holder for literature and coupons, and a blank for making such a holder, have been provided which fully meet the stated objectives. While the invention has been described in terms of a preferred embodiment, it is not intended to limit the invention to the same, but to include all equivalents and modifications within the scope of the claims to follow.

What is claimed is:

1. A substantially flat die cut and scored blank made of thin, stiff material, for assembling into a holder for brochures, coupons or folders, which will be referred to as literature, comprising in combination, two die cut shelf strip panels, each having an angled cut on one side, and a cut shaped like the round metal edge of a retail store's pricing channel, which forms the facing edge of a store shelf, on the other side;

two rectangular side panels, for holding literature in the holder upright when the holder is assembled from the blank form, attached to and adjoining the two shelf strip panels and which side panels meet together at a common score;

two bottom panels, attached to the side panels, and which bottom panels, when the flat blank is assembled, provide a secure bottom platform for the holder's contents, bracing the side panels in position, each of which bottom panels hinge from a score on the edge of the two side panels;

a die cut termination of the two rectangular bottom panels by die cutting them short of the length which they extend along the rectangular side panels by a distance approximately equal to the width of the bottom panels, which when the flat blank is assembled is approximately the inside width of the holder, enabling the holder to fold at the score joining the two side panels without binding or bunching at the end, providing a smooth narrow contour to the end of the literature holder when assembled;

a male tab lock which extends from one of the bottom panels which adjoins one of the rectangular side panels, can tuck into, and lock with a female lock cut in the score of the other bottom panel which adjoins the opposite side panel, which when the flat blank is formed into a holder, forms a bottom platform upon which literature may be placed, and holds the side panels in place.

2. The blank described in claim 1 which when assembled into a holder may be attached to a store pricing channel and by cantilevering the weight of literature which may be placed in it against a store shelf, will maintain the literature at an approximately level attitude for display at 90 degrees to the store shelf, for optimum viewing by persons approaching from either direction.

3. The blank described in claim 2 wherein the blank may be printed so that when assembled into a holder for literature and attached to a store pricing channel for display at 90 degrees from a store shelf, the printing will call attention to the literature it contains.

4. The blank described in claim 1, wherein the shelf strip panels allow the literature holder when assembled to be attached to a store pricing channel without use of additional fastening devices, tools, adhesives or adhesive devices.

5. The blank described in claim 1 when assembled into a literature holder and attached to a store shelf pricing channel, the literature holder is secured there by the two shelf strip panels, each of which is attached to one said side panel by a score which folds at 90 degrees to the shelf carrying the pricing channel, projecting the side panels, which relate to the wider display dimension of the literature holder, at approximately 90 degrees from the shelf, leaving the narrow profile defined by the common score which joins the two side panels in front of the shelf, offering minimum interference with view of, or access to, product on the shelf.

6. A holder for literature, which holder may be made of thin, stiff material, comprising two die cut shelf strip panels, each of which have an angle cut in the top surface, and a circular cut describing the shape of the round edge of a retail store's pricing channel which is located at the outer edge of a shelf facing the store aisle;

two rectangular side panels for holding the contents of the holder upright, attached to and adjoining the two shelf strip panels, and which side panels are hinged together by a score;

two rectangular bottom panels, attached to the side panels, which bottom panels provide a secure bottom platform for the holder's contents, and which brace the side panels in upright position, each of which bottom panels hinge from a score on the bottom of each of the two rectangular side panels;

a die cut termination of the two rectangular bottom panels by die cutting them short of the length of the rectangular side panels by a distance approximately equal to the width of the bottom panels, which is approximately the inside width of the holder, enabling the holder to fold at the score joining the two side panels, without binding or bunching providing a smooth narrow contour to the end of the literature holder;

a male tab lock extending from one bottom panel which inserts in a female lock cut in the score joining the opposite bottom panel to the side panel, locking the panels in place.

7. The literature holder of claim 6 which when attached to a store pricing channel, cantilevers the weight of the literature placed in it against the associated store shelf, permitting the holder to maintain an approximately level attitude, displaying contents at approximately 90 degrees to the store shelf, for optimum viewing by persons approaching from either direction.

8. The literature holder of claim 6 wherein the holder is printed so that when attached at 90 degrees to the store shelf; the printing will call attention to literature it contains.

9. The literature holder of claim 6 wherein the shelf strip panels allow the literature holder to be attached to a store's pricing channel without additional fastening devices, tools or adhesives.

10. The literature holder described in claim 6, when attached to a store shelf pricing channel, is secured to the channel by the two shelf strip panels, which are attached to the side panels by a score which folds at 90 degrees to the shelf projecting the side panels, which relate to the wide display dimension of the literature holder, at 90 degrees from the shelf, leaving the narrow profile of the common score which joins the two side panels in front of the shelf, offering minimum interference with view of, or access to, product on the shelf.

* * * * *

UNITED STATES PATENT AND TRADEMARK OFFICE

CERTIFICATE OF CORRECTION

PATENT NO. : 5,423,425

DATED : June 13, 1995

INVENTOR(S) : Brian K. Stompe

It is certified that error appears in the above-indentified patent and that said Letters Patent is hereby corrected as shown below:

On the title page, item [54] and column 1, lines 2-3, the title should read --STORE SHELF LITERATURE HOLDER AND BLANK THEREFOR--

Signed and Sealed this

Twenty-first Day of November, 1995

*Attest:*

Bruce Lehman

BRUCE LEHMAN

*Attesting Officer*

*Commissioner of Patents and Trademarks*